US005685460A

United States Patent [19]

Vlastuin

[11] Patent Number: 5,685,460

[45] Date of Patent: Nov. 11, 1997

[54] DEVICE FOR DISPENSING DOSED QUANTITIES OF A BULK MATERIAL SUCH AS CONFECTIONERY

[75] Inventor: Cornelis Jan Vlastuin, Baarn, Netherlands

[73] Assignee: Van Melle International B.V., Breda, Netherlands

[21] Appl. No.: 496,678

[22] Filed: Jun. 29, 1995

[30] Foreign Application Priority Data

Jul. 5, 1994 [NL] Netherlands ..... 9401123

[51] Int. Cl.[6] ..... B67D 5/38

[52] U.S. Cl. ..... 222/154; 222/368; 222/564

[58] Field of Search ..... 222/132, 135, 222/142, 154, 158, 159, 185.1, 368, 547, 564

[56] References Cited

U.S. PATENT DOCUMENTS

| | | | |
|---|---|---|---|
| 2,269,761 | 1/1942 | Gauvreau | 222/154 |
| 2,861,720 | 11/1958 | Zilke | 222/368 |
| 2,907,501 | 10/1959 | Laird | 222/564 |
| 3,735,899 | 5/1973 | Rollinson | 222/368 |
| 3,758,004 | 9/1973 | Garrett et al. | 222/368 |
| 4,632,257 | 12/1986 | Negishi et al. | 211/592 |
| 4,776,489 | 10/1988 | Tarlow et al. | 222/132 |
| 4,960,229 | 10/1990 | Dumbaugh | 222/564 |

FOREIGN PATENT DOCUMENTS

| | | |
|---|---|---|
| 1 206 451 | 6/1986 | Canada . |
| 93 03 690.6 | 6/1993 | Germany . |
| 2 108 092 | 5/1983 | United Kingdom . |

*Primary Examiner*—Philippe Derakshani
*Attorney, Agent, or Firm*—Banner & Witcoff, Ltd.

[57] ABSTRACT

A device for dispensing dosed quantifies of bulk material such as confection, wherein bridge forming is effectively prevented and mutually adhering particles of the bulk material can be loosened from each other, the device including at least one dispenser chute containing the bulk material, the chute having a filling opening and a dispensing opening and being formed by a transparent front wall, a rear wall and two side walls, and a dispensing mechanism arranged therein for dispensing a measured quantity of bulk material at a time through the dispensing opening, the chute further including guide surfaces preferably arranged alternatively in the longitudinal direction of the chute on at least two walls thereof.

16 Claims, 5 Drawing Sheets

DEVICE FOR DISPENSING DOSED QUANTITIES OF A BULK MATERIAL SUCH AS CONFECTIONERY

FIELD OF THE INVENTION

The present invention relates to a device for dispensing dosed quantities of a bulk material such as confectionery, said device comprising: at least one dispensing chute containing said bulk material, each having a filling opening and a dispensing opening, said chute being formed by a transparent front wall, a rear wall and two side walls, and a dispensing mechanism arranged in said chute for dispensing a measured quantity of bulk material at a time through said dispensing opening.

BACKGROUND OF THE INVENTION

It is known to make use in such a device of a dispensing mechanism, for example in the form of a dispensing roller, comprising a cylindrical body mounted rotatably about a lying axis to which surfaces are arranged in such a way that each intersection line of said surfaces lies to the side of said axis of rotation. As a result of rotation of said dispensing mechanism a dosed quantity of said bulk material placed in said dispensing chute is poured out through said dispensing opening and also bulk material remaining behind in said chute is pushed upward in order to obviate the danger of bridge-forming thereof in said chute. However, in the case of a high upright chute the risk of bridge-forming remains as a result of the weight and the usually resilient properties of bulk material placed in said chute.

SUMMARY OF THE INVENTION

The invention has for its object to obviate the above stated drawbacks and provides for this purpose a device which is distinguished in that at least one downward oriented guide surface is arranged above said dispensing mechanism in said chute. In preference guide surfaces in said chute are arranged alternately in the longitudinal direction of said chute on at least two inner walls thereof.

Said bulk material is displaced along a meandering path formed by said guide surfaces when said material moves in downward direction to said dispensing mechanism as bulk material is discharged from said chute in each case by said dispensing mechanism, where said the bulk material is not obstructed by bridge-forming as a result of said displacement and the upward push generated by said dispensing mechanism, irrespective of the height of said chute and the properties of said bulk material.

BRIEF DESCRIPTION OF THE DRAWINGS

The invention is further elucidated with reference to the figure descriptions following hereinbelow of preferred embodiments of the invention. In the drawing.

DETAILED DESCRIPTION OF THE PREFERRED EMBODIMENT

Figure 1:
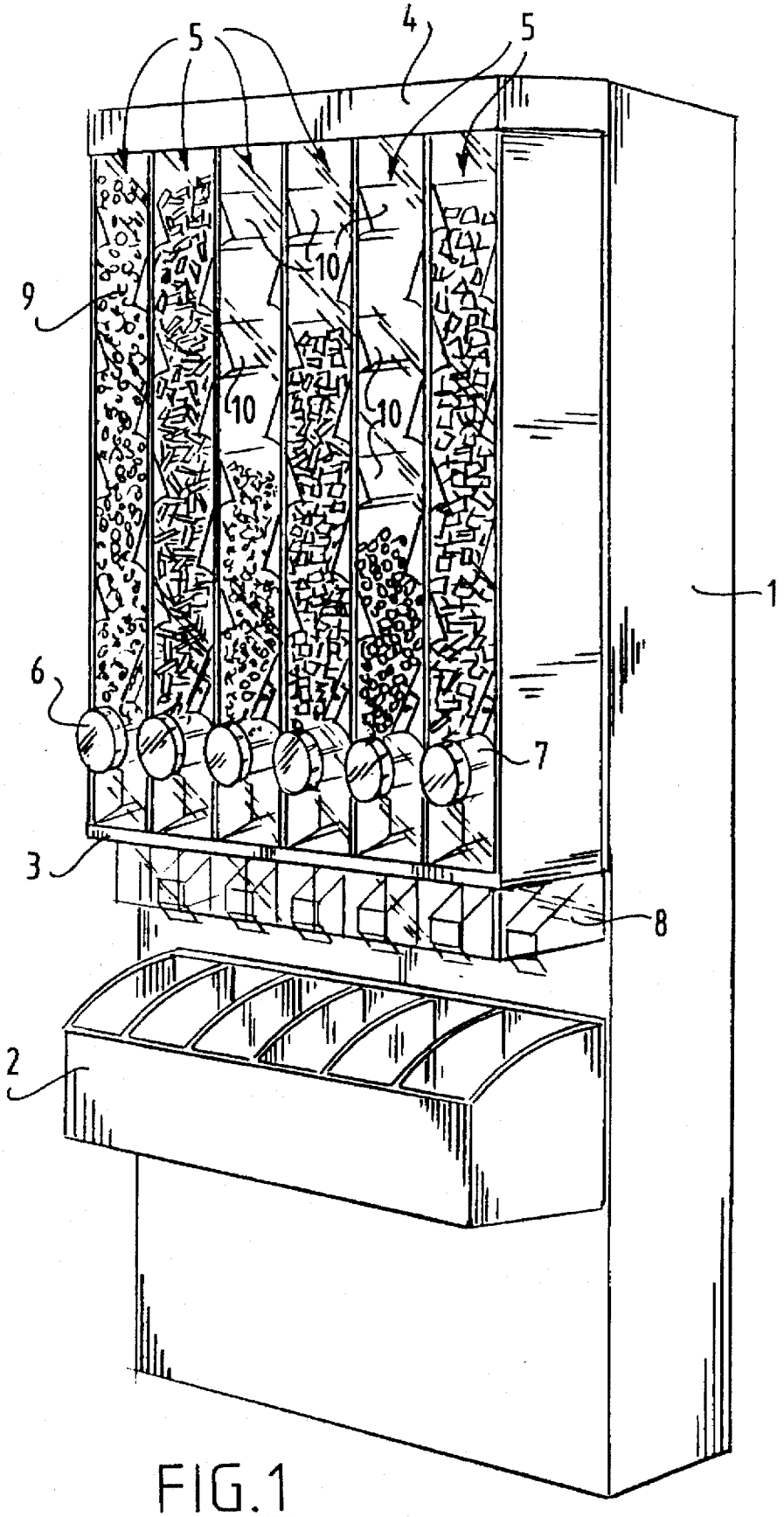
FIG. 1 shows a perspective front view of said device according to the invention.

The embodiment of the invention shown in FIG. 1 comprises: a standing cabinet 1; a series of trays 2; dispensing chutes 5; and strips 3, 4.

Dispensing chutes 5 are placed on a series of throughfeed channels 8 mounted above the series of trays 2 on upright cabinet 1 wherein said series of throughfeed channels 8 is provided along the upper edge thereof with a strip 3, preferably of metal, which ensures that the undersides of chutes 5 remain in place. Standing cabinet 1 is provided on the top side thereof with a strip 4, preferably of metal, which prevents chutes 5 from falling over.

Chutes 5 are provided at the bottom side thereof with a dispensing mechanism comprising a dispensing roller 7 in the interior of chute 5 and a rotatable disc 6 outside chute 5 for operating dispensing roller 7. By turning dispensing roller 7 using the hand-rotatable disc 6 bulk material 9 is allowed to pass and falls through throughfeed channels 8 into one of said series of trays 2. When dispensing roller 7 rotates bulk material 9 remaining in chute 5 is pushed slightly upward, whereafter bulk material 9 drops downward again, whereby bridge-forming is prevented. In each chute 5 guide surfaces 10 are arranged from the side walls thereof, wherein guide surfaces 10 are arranged alternatingly on one side wall at a time in lengthwise direction of said chute 5. This will be discussed further hereinbelow.

Figure 2:
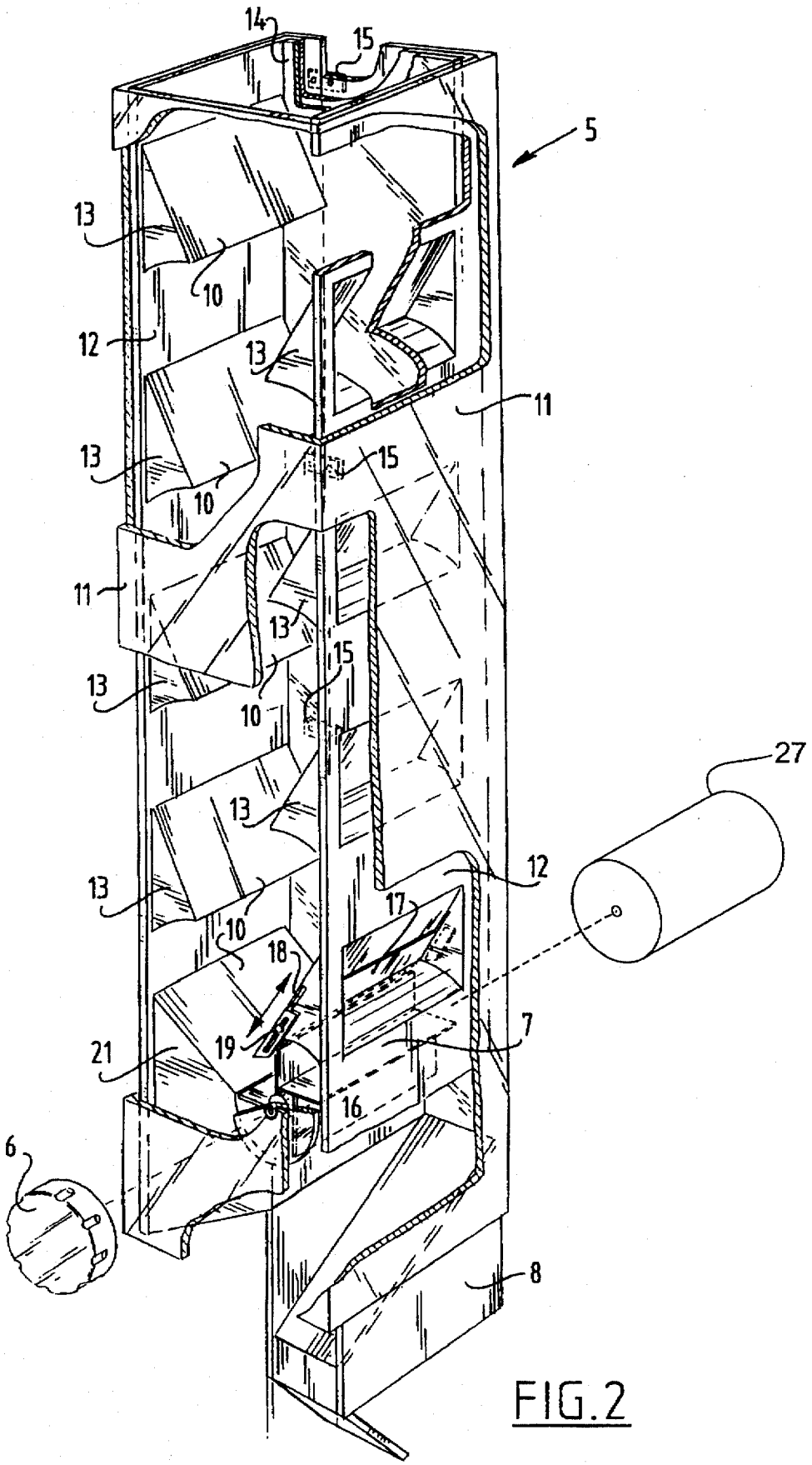
FIG. 2 is a partly cut away perspective view of a dispensing chute applied in the device shown in FIG. 1.

The embodiment of an individual dispensing chute 5 shown in FIG. 2 comprises: a case 11; a plate 12 which is U-shaped in horizontal section and which has protrusions 13, 16 and 21 forming guide surfaces 10; a dispensing roller 7; a hand-rotatable disc 6; and a mirror panel 14. In another embodiment, dispenser roller 7 may be connected to motorized drive 27.

Case 11 is embodied as a sheet of transparent plastic folded to a square tube in horizontal cross section, said sheet being closed at the rear along a closing line with closing elements 15. In case 11 a plate 12 is placed, in which the protrusions 13, 16, 21 are arranged. As shown in FIG. 2, every cross section of the along the length of chute 5 has a substantially identical shape, e.g., rectangular or square, along the entire length of chute 5. Plate 12 of U-shaped horizontal section is formed integrally for both inner side walls of chute 5 and here also covers the rear wall thereof. A mirror panel 14 is placed against the part of folded plate 12 covering the rear wall of chute 5. Mirror panel 14 is secured against horizontal movement since said mirror panel 14 is clamped between protrusions 13, 16 and 21 and the part of folded plate 12 covering the rear wall of chute 5. Mirror panel 14 can be removed by sliding said mirror panel 14 upward, which is also the case for folded plate 12, whereby cleaning of separate components of chute 5 can be performed in simple manner. Folded plate 12 will be further described below.

Guide surface 10 formed by protrusion 16 at the bottom of chute 5 above dispensing roller 7 is adjustable in order to control rate of flow into dispensing roller 7, that is, guide surface 10 formed by said protrusion 16 can be extended to a greater or lesser extent above dispensing roller 7 in that a slide plate 17 is placed in a slit 18 arranged in said protrusion 16 under this guide surface 10. Slide plate 17 can be locked in a determined position relative to guide surface 10 by operating a fastening element 19 is formed by an adjustment bolt which can be tightened or loosened through an opening in the front wall of case 11, where said opening extends along a line having a length corresponding to different positions of slide plate 17. The shaft of dispensing roller 7 protrudes through a hole in the front wall of case 11 and hand-rotatable disc 6 engages hereon, whereby dispensing roller 7 is set into movement by rotation of disc 6.

Dispensing roller 7 is arranged at a position such that it is situated for the greater part below the protrusion 16.

Protrusion 21 arranged adjacent dispensing roller 7 likewise forms a guide surface 10 and further encloses the rotation zone of dispensing roller 7, preventing bulk material from falling past dispensing roller 7 on this side when disc 6 is not being rotated.

Figure 3:
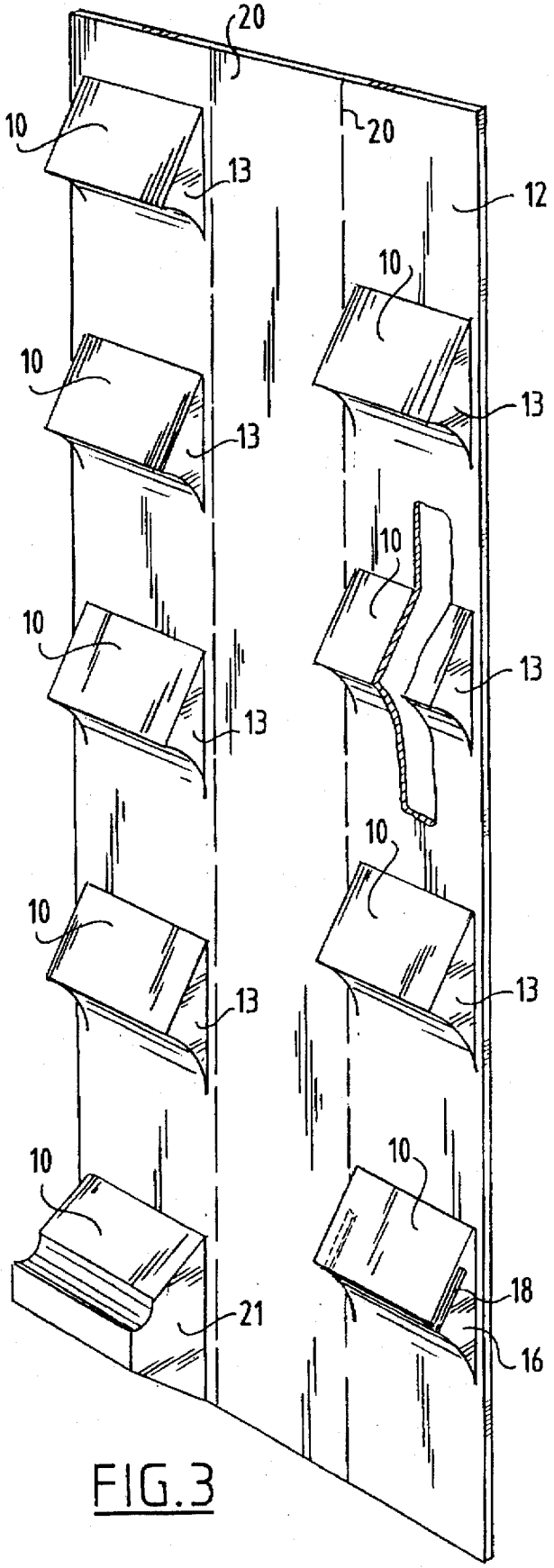
FIG. 3 shows a first embodiment of a flat plate forming guide surfaces in the chute of FIG. 2.

Plate 12 used in FIG. 2 is shown in FIG. 3. Plate 12 is preferably made of plastic, wherein protrusions 13, 16, 21 forming guide surfaces 10 are formed by means of a shaping operation such as a vacuum technique. Protrusions 13 and protrusion 16 are sawtooth-shaped in vertical section. Protrusion 16 at the bottom of chute 5 above dispensing roller 7 is provided with a slit 18 in which slide plate 17 is placed. Fold lines 20 on foldable plate 12 arranged corresponding with the lengthwise direction of chutes 5 are shown in the drawings as dashed lines. The distance between the side wall of each protrusion 13, 16, 21 facing toward a closest fold line 20 and said fold line 20 corresponds with the thickness of the mirror panel 14. The distance between the side wall of each protrusion 13, 16, 21 facing toward a closest edge of the plate 12 and said edge is preferably as small as possible in order to prevent jamming of bulk material between any protrusion side wall and the front inner surface of case 11.

Figure 4:
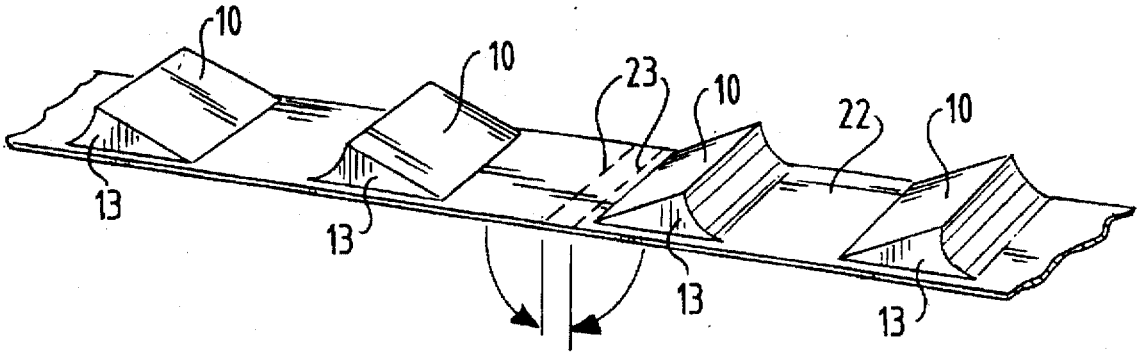
FIG. 4 is a view of another embodiment of a flat plate forming guide surfaces in said chute.
Figure 5:
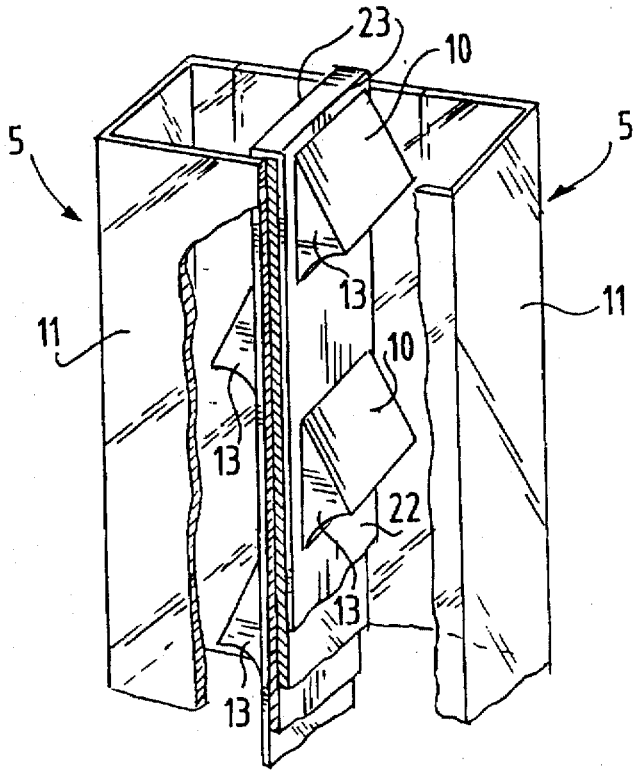
FIG. 5 is a partly cut away view of chutes, wherein the flat plate shown in FIG. 4 is applied.

In FIG. 4 and 5 another embodiment is shown of a part of a device according to the present invention. In this embodiment the distance between fold lines 23 in plate 22 corresponds to twice the thickness of the wall of case 11, wherein plate 22 contains the protrusions 13 forming guide surfaces 10. Fold lines 23 are arranged in width direction of the plate 22 so that plate 22 can slide over mutually opposite side walls of two cases 11 when plate 22 is folded along fold lines 23 in the direction of the arrows in FIG. 4 to the position shown in FIG. 5. A mirror panel (not shown) can be placed behind the protrusions 13 against the rear wall of case 11 so that the plate 22 and the mirror panel are held in the desired position.

In this way it is further ensured that cases 11 forming chutes 5 remain in an abutting position. Mirror glass panels and plates 22 with protrusions 13 formed therein can be removed from cases 11 by sliding these components upward in order to facilitate cleaning of individual components.

Figure 6:
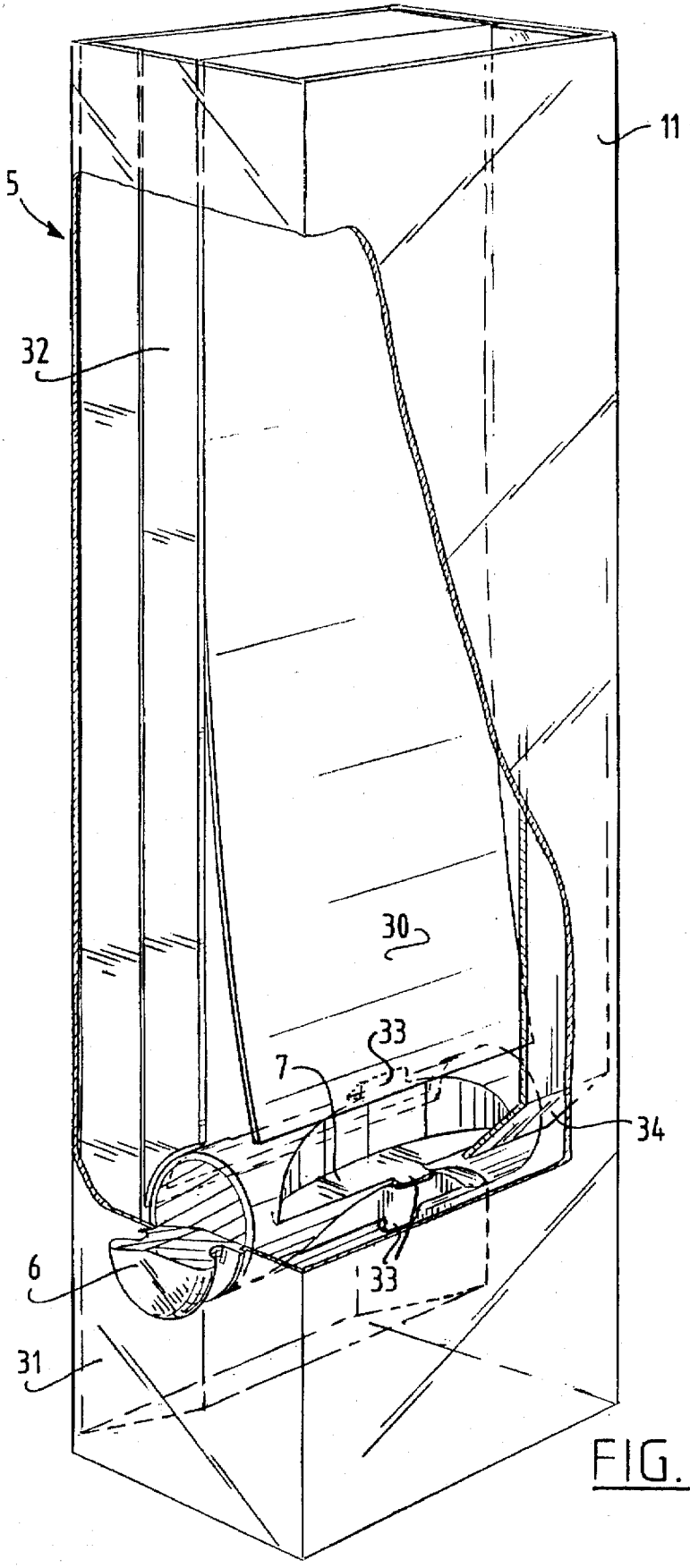
FIG. 6 is a partly cut away perspective view of another embodiment of a chute according to the invention.

FIG. 6 shows another embodiment of a dispensing chute 5 in a device according to the present invention. In the embodiment shown here chute 5 comprises: a case 11; a dispensing roller 7; a hand-rotatable disc 6; constricting elements 31 and 32; a guide surface embodied as flexible plate 30; and a guide plate 34.

Dispensing roller 7 is placed in the semi-cylindrical-shaped recess formed by constricting elements 31 and 32 in which dispensing roller 7 can rotate when hand-rotatable disc 6 is turned. Constricting elements 31 and 32 are fixed to each other, wherein constricting element 31 is placed against an inner side wall of case 11, whereby the space available for bulk material in chute 5 is enclosed by the other inner side wall of case 11 and the constricting element 32. Guide plate 34 is arranged on the inner wall of case 11 closing off the space between dispensing roller 7 and this side wall of case 11 to bulk material, preventing bulk material from falling past dispensing roller 7 on this side when the latter is not being turned.

Flexible plate 30 is fixed to constricting element 32, wherein the lower, free end of plate 30 is pressed in the direction of constricting element 32 by the weight of bulk material in chute 5. When however dispensing roller 7 is rotated, the lower end of flexible plate 30 is pushed away by the pusher elements 33 of dispensing roller 7, wherein bulk material in chute 5 is pushed slightly upward by the movement of flexible plate 30. Bulk material close to the lower edge of flexible plate 30 is hereby relieved of the weight of bulk material lying thereabove so that jamming of dispensing roller 7 is avoided and whereby prevention of bridge-forming in the chute is ensured. A vibration relative to a position of equilibrium of flexible plate 30 further results in mutually adhering particles of the bulk material being vibrated loose of each other. Similar to FIG. 2, the cross section along the entire length of chute 5 has a substantially identical shape.

I claim:

1. Device for dispensing dosed quantities of a bulk material such as confectionery, said device comprising:

at least one dispensing chute containing said bulk material, said chute having a filling opening and a dispensing opening said chute being formed by a plurality of upright walls;

a dispensing mechanism arranged in said chute for dispensing a measured quantity of bulk material through said dispensing opening each time said dispensing mechanism is activated;

at least one downward oriented guide surface connected to one of said walls above said dispensing mechanism, characterized in that said guide surface extends inwardly into said chute angled with respect to said wall, at which every cross section of said chute to be traversed by said bulk material perpendicular to the direction along the length of said dispensing chute has a practically identical shape along the entire length of said dispensing chute, and said at least one guide surface acting in cooperation with said dispensing mechanism to prevent bridging of said bulk material.

2. Device as claimed in claim 1, characterized in that guide surfaces in said chute are arranged alternately in the longitudinal direction of said chute on at least two inner walls thereof.

3. Device as claimed in claim 1, characterized in that each guide surface extends into the interior of said chute over a distance which is at most equal to half the width of said chute.

4. Device as claimed in claim 1, characterized in that at least one guide surface is formed by a protrusion on said wall, said protrusion being substantially sawtooth-shaped, where the point of said protrusion is directed toward the interior of said chute.

5. Device as claimed in claim 1, characterized in that at least the guide surface immediately above said dispensing mechanism is adjustable in the length.

6. Device as claimed in claim 1, characterized in that at least one plate is placed in said chute, said plate having at least one protrusion formed thereon.

7. Device as claimed in claim 6, characterized in that at least one plate is provided with at least one fold line.

8. Device as claimed in claim 6 or 7, characterized in that at least one vacuum shaped protrusion is formed on said plate.

9. Device as claimed in claim 8, characterized in that said plate is formed by a plastic.

10. Device as claimed in claim 1, characterized in that at least one guide surface is provided in the form of a flexible plate.

11. Device as claimed in claim 10, characterized in that said flexible plate is fixed to a constricting element placed against a wall of said chute.

12. Device as claimed claim 1, characterized in that a mirror panel is placed in said chute said mirror panel covering the rear wall thereof.

13. Device as claimed in claim 1, characterized by at least one cover for closing at least one filling opening.

14. Device as claimed in claim 1, characterized in that said dispensing mechanism is provided in the form of a cylindrical body rotatable transversely of the longitudinal direction of said chute and having recesses in the outer surface thereof.

15. Device as claimed in claim 14, characterized in that said cylindrical body is connected to drive means for manual or motorized drive of said cylindrical body.

16. Device for dispensing dosed quantities of a bulk material such as confectionery, said device comprising:

at least one dispensing chute containing said bulk material, said chute having a filling opening and a dispensing opening, said chute being formed by a transparent front wall, a rear wall and two side walls;

a dispensing mechanism arranged in said chute for dispensing a measured quantity of bulk material through said dispensing opening each time said dispensing mechanism is activated;

at least one downward oriented guide surface is arranged above said dispensing mechanism;

at least the guide surface immediately above said dispensing mechanism is adjustable in the length, and the length of said guide surface is adjustable by means of a slide plate which is placed slidably and fixably in a slit arranged parallel to said guide surface.

* * * * *